US007946693B2

(12) United States Patent
Pechtl

(10) Patent No.: US 7,946,693 B2
(45) Date of Patent: May 24, 2011

(54) PRODUCING AND DEFLECTING INK DROPLETS IN A CONTINUOUS INK-JET PRINTER

(75) Inventor: Klaus Pechtl, Stadtschwarzach (DE)

(73) Assignee: KBA-Metronic AG, Vietshochheim (DE)

( * ) Notice: Subject to any disclaimer, the term of this patent is extended or adjusted under 35 U.S.C. 154(b) by 278 days.

(21) Appl. No.: 12/166,556

(22) Filed: Jul. 2, 2008

(65) Prior Publication Data

US 2009/0009567 A1 Jan. 8, 2009

(30) Foreign Application Priority Data

Jul. 6, 2007 (DE) ..... 10 2007 031 658

(51) Int. Cl.
*B41J 2/105* (2006.01)

(52) U.S. Cl. ..... 347/82

(58) Field of Classification Search ..... 347/82, 347/73–77, 80

See application file for complete search history.

(56) References Cited

U.S. PATENT DOCUMENTS

| | | | | |
|---|---|---|---|---|
| 3,595,994 | A | 7/1971 | Whitman | 178/66 |
| 4,190,844 | A | 2/1980 | Taylor | |
| 4,287,522 | A | 9/1981 | Meyer | |
| 4,620,196 | A * | 10/1986 | Hertz et al. | 347/76 |
| 6,364,470 | B1 | 4/2002 | Cabal | 347/82 |
| 6,851,796 | B2 * | 2/2005 | Jeanmaire et al. | 347/74 |
| 7,686,435 | B2 * | 3/2010 | Gao et al. | 347/77 |
| 2006/0180517 | A1 | 8/2006 | Frazier | 209/579 |
| 2008/0088680 | A1 * | 4/2008 | Xu et al. | 347/75 |

FOREIGN PATENT DOCUMENTS

DE 10307055 9/2004

* cited by examiner

*Primary Examiner* — K. Feggins
(74) *Attorney, Agent, or Firm* — Andrew Wilford

(57) ABSTRACT

The invention relates to a method and a device for producing and deflecting ink drops in a continuous ink-jet printer in which a continuous cohesive ink jet exits from a nozzle of a pressure chamber, and in which at least one acoustic pulse (140, 142, 142*a*) strikes the cohesive ink jet (9) transversely to the propagation direction, and one segment of the ink jet (9) upon which the acoustic pulse (140, 142, 142*a*) acts is separated from the cohesive ink jet (9) and deflected from its original propagation direction (100), the separated segment forming an ink drop (11) during its travel due to cohesion forces.

23 Claims, 3 Drawing Sheets

PRODUCING AND DEFLECTING INK DROPLETS IN A CONTINUOUS INK-JET PRINTER

FIELD OF THE INVENTION

The invention relates to a method for producing and deflecting ink drops in a continuous ink-jet printer in which a continuous cohesive ink jet exits from a nozzle of a pressure chamber. The invention furthermore relates to a device for producing and deflecting ink drops from a cohesive ink jet including a pressure chamber having a nozzle for producing a continuously exiting cohesive ink jet.

BACKGROUND OF THE INVENTION

Continuous ink-jet printers have been employed in industrial use for many years for marking a wide variety of products. The working principle for these ink-jet printers in the past has functioned such that an ink to be applied is supplied from a reservoir via pumps with positive pressure to a pressure chamber that is provided in the actual print head and that has a nozzle on its side facing the article to be printed.

The nozzle has an opening diameter in the range of e.g. 30 μm to 200 μm. The ink jet exits from the nozzle initially as a continuous ink jet, but this is not useful for printing because the characters produced in this type of printing job are constructed from individual points or individual ink drops.

In order to break down the ink jet into uniform individual ink drops, attached to the pressure chamber is a modulation element that creates pressure fluctuations in the exiting ink jet so that a short time after it exits from the nozzle the ink jet breaks up into uniform individual ink drops at a defined spacing. The size of the ink drops is a function of the modulation frequency applied, nozzle diameter, and the pressure produced by the pump, and it can be adjusted within the limits for the system that are prescribed by the combination of the above-described parameters. It is not possible to vary the drop size of successive ink drops.

Shortly before the ink drops are formed from the ink jet that has exited, the ink drops are each individually provided with an electrical charge, the amount of the charge being a function of the desired impact position on the product to be marked. The ink is slightly electrically conductive in order to ensure the electrical charging.

During the charging process, the ink drop has not yet been broken off from the ink jet that has exited from the nozzle of the ink-jet printer so that due to the electrical influence free charge carriers in the ink are moved toward or away from the charge electrode, depending on the polarity and strength of an external charge voltage, the ink chamber and thus the ink reservoir being held for instance electrically to ground potential. The charge electrode has no mechanical contact with the ink jet.

If the ink drop now breaks off from the ink jet while it is in the field region of the charge electrode, the electrical charges that have migrated into the drop due to the influence remain in the drop volume and the latter is also electrically charged to the outside even after it has broken off. If the charge electrode is positively charged, for instance, when the ink jet enters the electrical field of the charge electrode the negative free charge carriers in the ink migrate into the field, while the positively charged free charge carriers in the ink are displaced from the electrical field.

Thus a charge separation occurs on the front edge of the ink jet immediately before the drop breaks off and the charge equilibrium thus produced is maintained in the drop that is breaking off and the drop leaves the field region of the charge electrode, in this example with a negative charge.

Since, due to structure and principle, the ink drop breaks off during the period in which the charge voltage influences the drop, as described, a charge remains on the ink drop that has separated and the amount of the charge corresponds to the amount of the applied charge voltage given constant electrical conductivity of the ink and thus, 0given a change in the charge voltage, the charge in each drop can also be altered.

During their travel, which is initially in a straight line, the electrically charged ink drops successively enter the electrostatic field of a plate capacitor and are more or less deflected from their straight trajectory depending on their individual charge and after leaving the electrostatic field continue their travel at a specified angle to their original trajectory, the angle being determined by their charge.

With this principle it is possible to select different impact positions on a surface to be printed with individual ink drops, this occurring only in one deflection direction in this embodiment. For blocking individual drops from the image zone or if printing is not to occur, the ink drops are given a certain fixed charge or remain uncharged so that after they exit from the electrostatic field of the plate capacitor they are captured in a collection tube, from which location they are pumped back to the ink tank via a pump system. Thus the ink that is not used in printing is circulated in the cycle, which is why it is called a continuous ink-jet printer.

In the above-described conventional embodiment it is disadvantageous that, due to the system-imposed manner of deflecting the ink drops, the ink itself must be electrically conductive, even if only slightly, so that the individual charge required for the electrostatic deflection can be applied to each individual ink drop.

This limits the number of inks that can be employed, since it is not possible or useful to provide for each desired ink composition electrical conductivity itself or via additives. For instance, there may be an ink that has magnetic properties. Such an ink could be created to be electrically conductive, for instance by means of an additive, but then it would not be possible to control the trajectories of the individual ink drops based on the induction that occurs and the associated different additional deflection forces.

In contrast to this, DE 103 07 055 describes a method for deflecting ink drops that, by means of an ultrasound wave, depending on expended sonic energy, deflects with different strengths the ink drops produced in the normal manner by pressure modulations in the ink.

It is advantageous in terms of this type of deflection that the inks to be printed do not have to be electrically conductive, which makes it possible to use a great number of very different inks with different properties.

For the system described in DE 103 07 055, it is disadvantageous that, first, drop production and drop deflection must be precisely synchronized, which also must take into account the final propagation speed of the sound waves at the site of the deflection as a function of the locally prevailing ambient conditions in order to make it possible to precisely deflect an ink drop to the desired position. It is furthermore disadvantageous that when using a simple sound generator, due to the size of the sound-generating surface, the acting acoustic energy acts not only exclusively on the ink drop to be deflected, but rather at least in part also on preceding and subsequent ink drops, so that precise deflection of the ink drops is only possible under certain conditions. It is furthermore disadvantageous that, due to their generation, the deflected ink drops are all the same size, so that type faces with different line widths cannot be produced without overlaying a plurality of ink drops and thus can only be produced in steps.

OBJECT OF THE INVENTION

The object of the invention is to create a method and a device with which it is possible to eliminate the above-described disadvantages. The object of the invention is furthermore to create a method and a device with which it is possible to produce differently sized ink drops within a printing job to be applied and to deflect the ink drops to a desired trajectory.

SUMMARY OF THE INVENTION

This object is attained according to the invention in that, in contrast to the known technique, individual ink drops are produced from a continuous and cohesive ink jet after the ink jet has left the nozzle of the pressure chamber in that at least one acoustic pulse is aimed at and strikes the cohesive ink jet transversely to the propagation direction, and one segment of the ink jet upon which the acoustic pulse acts is separated from the cohesive ink jet and deflected from its original propagation direction, the separated segment forming an ink drop during its travel due to cohesion forces.

The object is furthermore attained using a device of the type cited above in which at least one sound generator is arranged outside the pressure chamber and transversely to the ink jet, with which sound generator at least one acoustic pulse aimed at the ink jet can be generated and using which ink drops can be separated from the ink jet and can be deflected from their original direction.

By means of an acoustic pulse, preferably a bundled ultrasonic pulse or hypersonic pulse, a certain segment of the cohesive ink jet can be separated and this segment can be deflected to a trajectory that differs from its original trajectory. This is attained according to the invention in that to the side of the ink jet leaving the nozzle of the pressure chamber, preferably at a 90° angle, there is at least one sound generator that is actuated by means of a suitable electrical actuator via a higher-level controller and in particular emits short acoustic pulses that propagate as pulse-like acoustic waveforms in the direction of the ink jet.

It can preferably be provided according to the invention that the acoustic pulse is focused, e.g. in that between each sound generator and the ink jet are a focusing device for the acoustic pulses and with which the acoustic waves of the acoustic pulse that are emitted by each sound generator are each focused into one focal point.

In accordance with the invention it can be provided that the ink jet runs through each focal point so that the acoustic energy of the acoustic pulses can act on the ink jet in the best possible manner. If for instance the still cohesive ink jet is struck by at least one acoustic pulse in the focal point of a first sound-generating system, a certain segment of the ink jet is separated, so that the ink jet is interrupted by means of the energy transmitted via the acoustic pulse to the ink jet and by means of the associated acoustic pulse.

Since a movement pulse is simultaneously transmitted onto the separated segment of the ink jet via the acoustic pulse transverse to its original trajectory, the separated segment leaves the original trajectory of the ink jet and continues its travel at a certain angle to the original trajectory.

Along its further path, due to the cohesion forces of the ink, this segment separated from the ink jet forms an ink drop. Depending on the type of the at least one acoustic pulse and its temporal sequence, it is possible according to the invention, for instance with the separation of a segment from the ink jet, to simultaneously transmit thereto a certain required pulse for a certain change of direction transverse to the original trajectory, which causes the ink drop that resulted from this separated segment to follow a new trajectory that is at an angle to the original trajectory.

By varying for instance the duration of the acoustic pulse and/or the intensity of the acoustic pulse and/or the frequency spectrum of the acoustic pulse and/or its focusing, it is thus also possible according to the invention to separate individual ink drops from a continuous and cohesive ink jet and to force these separated ink drops to different trajectories that are at an angle to the original trajectory.

In this way it is possible for the trajectories of each of the ink drops to be arrayed in a fan-like shape to one another, so that for instance a print line can be written with a deflection in a direction transverse to the original trajectory. Those regions of the ink jet that are not needed for a print line that is to be constructed and that consequently also are not deflected by an acoustic pulse travel in the normal manner into the collection opening of a collection tube and are transported back into the ink cycle, for instance by means of a pump.

In another embodiment according to the invention, in addition to a first sound generator for generating individual ink drops from a continuous and cohesive ink jet, at least a second sound generator is provided that largely acts to deflect the separated, and in particular already once-deflected, ink drops. In this case, individual ink drops of largely the same size are separated from the continuous and cohesive ink jet, for instance by the first sound generator, in particular by means of a sequence of acoustic pulses having the same energy, intensity, duration, and frequency, and are deflected to a second trajectory at a certain angle to the original trajectory.

Then, when the ink drops thus produced cross through the focal point, in particular of the focusing device of the second sound generator, they are deflected with different acoustic pulses again, each in other different deflection directions, so that a fan-shaped array of trajectories results. In a first embodiment it can be useful to produce from the continuous and cohesive ink jet, by means of the first sound generator, only those ink drops that are actually needed in a print format that is to be written, or, in a second embodiment, to produce a continuous sequence of ink drops by means of the first sound generator and to further deflect by means of the second sound generator system only those ink drops that are required for a print format so that it is possible to have only a single collection device for the portions of the ink that are not required.

For sound generators for generating individual ink drops and/or deflecting them, for instance all known methods for generating sound can be used such as for instance electrodynamic converters, piezo-converters, electrostrictive converters, magnetostrictive converters, electrostatic converters, plasma sound generators, etc., at least some of the generated sound waves being focused according to the invention on one focal point.

To this end for instance an acoustic lens, a reflector material, or a combination thereof can be used. In accordance with the invention, the sound generator and in particular one or a plurality of sound-generating surfaces or sound-generating elements are configured such that their shape or arrangement acts like the Fourier transform of a point acoustic event and thus in its "return mode" generates sound waves that go out from this generator and are bundled largely in one focal point that is on the ink jet.

To this end, the sound-generating surface can be embodied in a simple instance for example as a Fresnel step plate, the sound-generating surface being divided into separate individually electrically actuatable concentric regions. By appropriately electrically actuating the regions in terms of amplitude, phase position, temporal course, and frequency spectrum it is thus possible, without additional acoustic lenses or reflectors, to generate a corresponding acoustic pulse and to bundle it in one focal point. Given a corresponding embodiment of the sound-generating surface and corresponding electrical actuation of the regions, it can also be useful to generate a plurality of acoustic focal points that are independent of one another in order thus for instance to generate ink drops in a first focal point and to deflect them individually appropriately in a second subsequent focal point. The various focal points can be generated by the same sound generator.

BRIEF DESCRIPTION OF THE DRAWING

The following figures show illustrated embodiments and the prior art.

SPECIFIC DESCRIPTION

Figure 1:
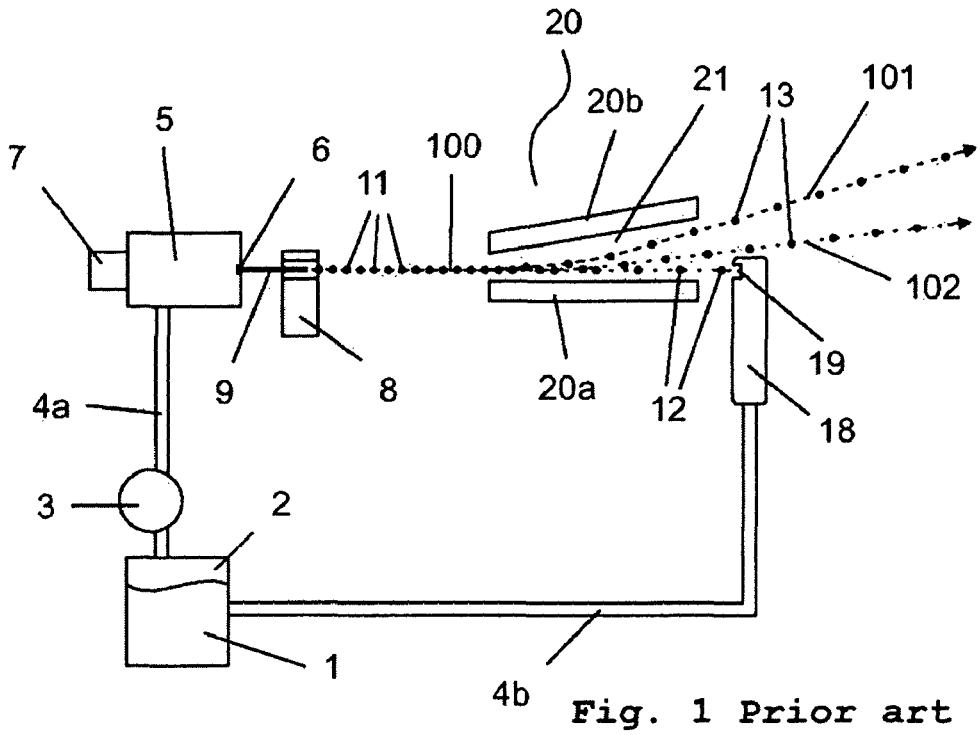
Fig. 1 Prior art
FIG. 1 shows an arrangement for generating ink drops and deflecting them in accordance with the prior art.

For a comparison with the invention, FIG. 1 shows as an example a print head of the known type in a continuous ink-jet printer. The ink 1 is initially pumped out of a reservoir 2 by means of a pump 3 via lines 4*a* into the pressure chamber 5, at the one end of which a nozzle 6 has been provided. The pressure in the pressure chamber 5 is modulated via modulators 7 that are also attached to the pressure chamber, such that shortly after it exits from the nozzle 6 the ink jet 9 breaks up into individual drops 11 that are largely the same size. Shortly prior to being broken up, the individual ink drops 11 are provided with an individual electrical charge via a charge electrode 8.

Along their trajectory 100 the ink drops 11 now enter an electrical field 21 that is formed by means of the electrodes 20*a* and 20*b* of the plate capacitor 20. The individual ink drops are deflected into different spatial directions 101, 102, shown as examples, depending on the charge and the polarity of the charge in the ink drops 11 and depending on the polarity and strength of the electrical field 21 in the field space of the plate capacitor 20.

The total number of potential deflection angles is merely a function of the actuation of the charge electrode and in principle is not limited. The individual plates 20*a* and 20*b* of the plate capacitor 20 can be positioned at an angle to one another, as shown in FIG. 1. However, without limiting the scope it is just as possible to use plates that are set parallel to each other.

In this embodiment, the polarity and strength of the electrical field 21 is advantageously largely kept constant, because a change in the field strength simultaneously affects a plurality of drops that are at this point in time in the field space of the plate capacitor and thus it is not possible to influence an individual drop.

Once they have left the field space 21 of the plate capacitor 20, no electrostatic force acts on the ink drops 11 any longer and they keep their new trajectories 101, 102. Thus a fan-shaped set of trajectories results. Ink drops 11 that for instance were not charged or were only slightly charged because they must be excluded from the image zone are for instance not deflected or are deflected only slightly in the electrostatic field 21 of the plate capacitor 20 and travel into an opening 19 of a collection tube 18 to be returned to the ink. The ink thus collected is returned via lines 4*b* to the ink reservoir 2 and thus is returned to the ink cycle.

It is easy to see that this working principle only functions with inks that have are electrically conductive, because otherwise it is not possible to charge the ink drops electrostatically.

Figure 2:
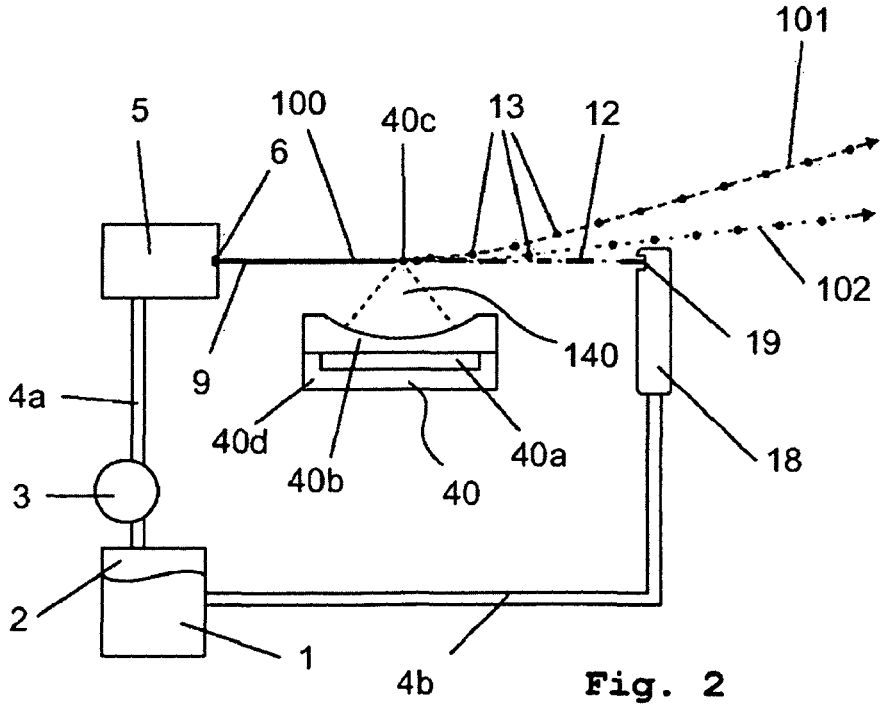
FIG. 2 shows a first a first inventive embodiment for generating ink drops and deflecting them having a sound-generating system.

FIG. 2 shows a first inventive embodiment for producing and deflecting ink drops of an ink that is not necessarily electrically conductive and especially of an ink that is not electrically conductive. The ink 1 is pumped out of a reservoir 2 by means of a pump 3 via lines 4*a* into a pressure chamber 5, at the one end of which a nozzle 6 is mounted.

Due to the pressure that is produced in the pressure chamber 5 by the pump 3 and that is largely static, the ink 1 exits the pressure chamber 5 via the nozzle 6 as a continuous and cohesive ink jet 9 along a propagation direction 100 and after a certain interval travels into the region of the sound-generating system 40. The sound-generating system 40 includes for instance a sound generator 40*a* that is mounted in a support 40*d* and that has a focusing device 40*b* on its side that faces the ink jet 9.

The spacing from the sound-generating system 40 to the ink jet 9 and in particular the embodiment of the focusing device 40*b* are determined such that the focal point of the focusing device 40*b* strikes the ink jet 9 moving along the propagation direction 100. Because of this, the sound waves 140 transmitted by the sound generator 40*a* are concentrated in a small region on the ink jet 9 such that because of this a certain acoustic energy and a certain acoustic pulse are transmitted to the ink jet 9 using the acting acoustic pulse so that a specific interval segment can be separated from the continuous and cohesive ink jet 9.

Depending on the pulse duration used, pulse shape, frequency composition, and acoustic energy converted in the sound generator 40*a*, more or less acoustic energy and a larger or smaller acoustic pulse is transmitted to the separated interval segment so that each interval segment can experience a different deflection angle and it is thus possible, using appropriate actuation by means of a higher-level controller (not shown), to intentionally produce different deflection angles for individual interval segments and thus for instance to address a print line.

Due to the cohesion forces prevailing in the interior of the ink, after a short time the interval segments separated in this manner, along their further deflection directions 101, 102, form individual drops 13 that can be used in a known manner for printing or marking.

Interval segments that are not required for the image and that thus must be excluded are not deflected via the sound-generating system 40 so that they continue to travel along their original propagation direction 100 and enter a collection opening 19 of a collection tube 18 and be transported back to the ink cycle in a known manner via return lines 4*b*.

Figure 3:
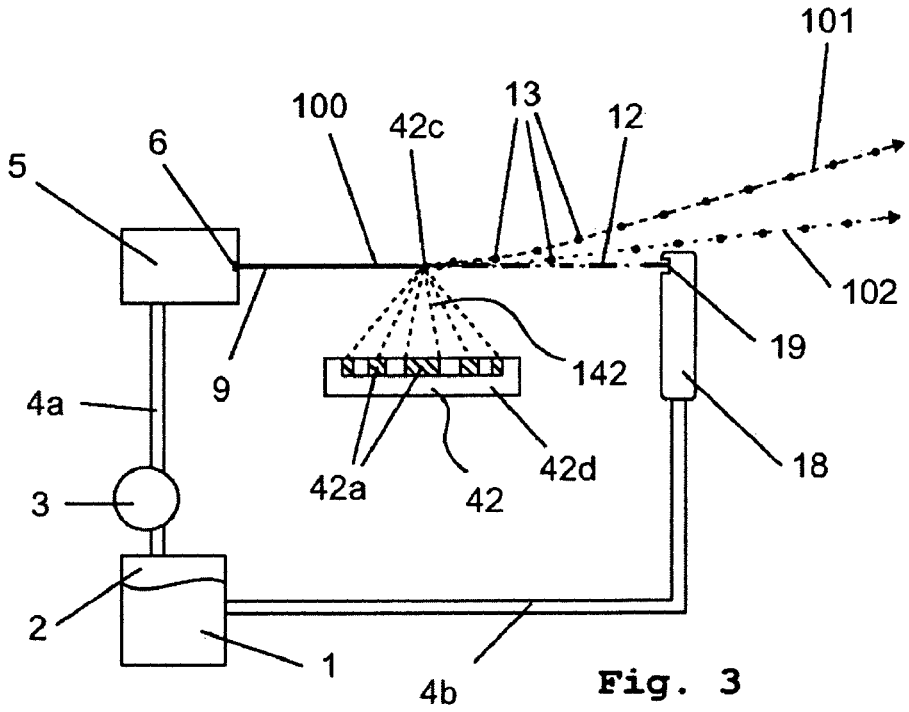
FIG. 3 shows a second inventive embodiment for generating ink drops and deflecting them having a Fourier-transformed sound-generating system.

FIG. 3 shows a second inventive embodiment for producing ink drops and for deflecting them, in which the sound-generating system 42 is embodied such that it can be operated as a Fourier transform system of a point acoustic event. Because of this it is possible to operate such a sound-generating system 42 without a focusing device, since, given appropriate actuation of the sound-generating segments 42*a*, the sound waves 142 are bundled by overlaying the amplitudes and phases in a common focal point 42*c*, so that in a similar manner individual interval segments can be separated from the ink jet 9 and deflected.

Figure 4:
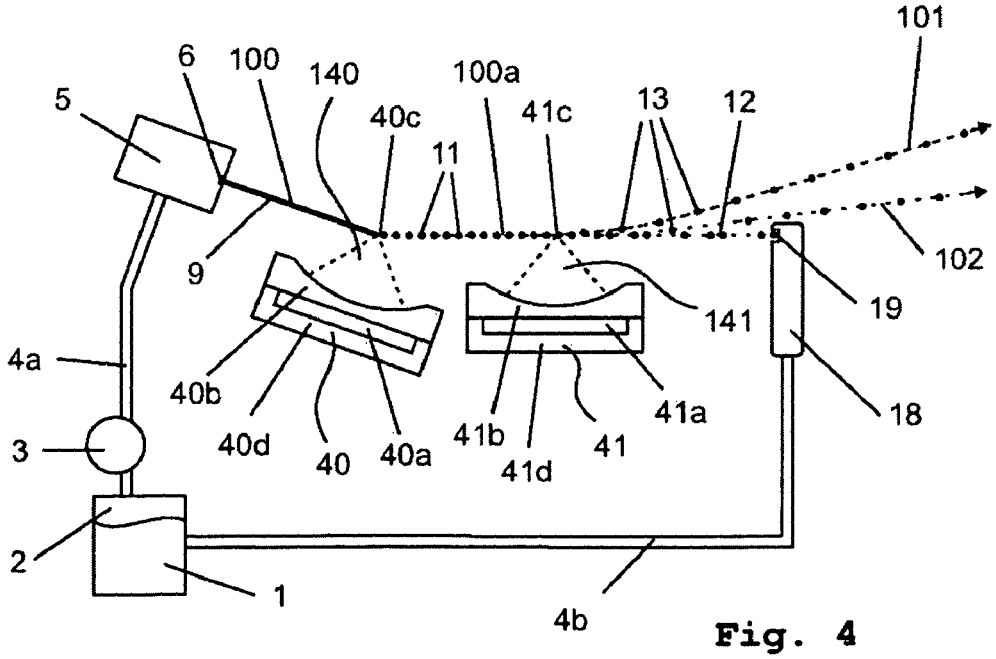
FIG. 4 shows a third inventive embodiment having two sound-generating systems that are independent of one another.

FIG. 4 shows a third embodiment for producing ink drops and deflecting them, in which embodiment two sound-generating systems 40 and 41 are provided that work independently of one another. It is provided according to the invention with a first sound-generating system 40 that the continuous and cohesive ink jet 9 is broken down into a continuous sequence of ink drops 11 in that for instance the sound-generating system 40 acts on the ink jet 9, which is propagating along its propagation direction 100, with an acoustic pulse sequence at a constant frequency so that the ink jet 9 is sequentially broken down into essentially identical ink drops 11 that are deflected into a new propagation direction 100*a*. Via the sound-generating system 41 arranged downstream thereof, ink drops are acted upon by at least one additional acoustic pulse synchronously with the drop frequency such that they change direction and, depending on the intensity and temporal course of the acoustic pulse acting on them, are deflected in a direction 101, 102. For instance, ink drops that are not needed for a printing job are not acted upon by acoustic pulses and therefore do not experience further deflection and in a known manner enter a collection opening 19 in a collection tube 18 and are transported back to the ink cycle via return lines 4*b*.

Figure 5:
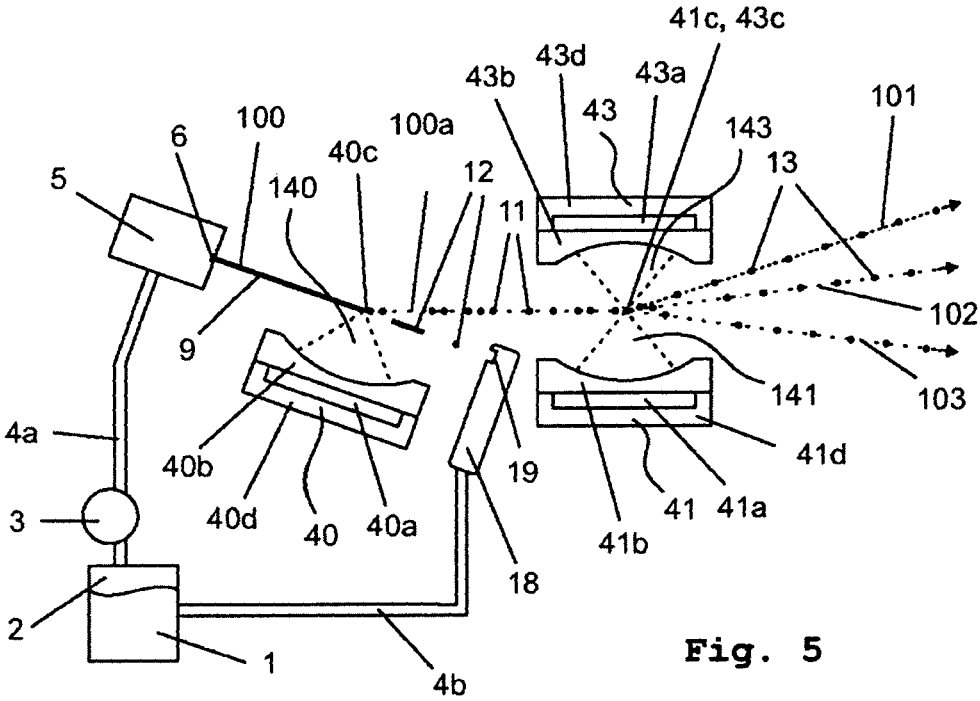
FIG. 5 shows a fourth inventive embodiment having three sound-generating systems that are independent of one another.

FIG. 5 shows a fourth inventive embodiment for producing ink drops and deflecting them, in which embodiment ink drops required for a print format are separated from the continuous and cohesive ink jet 9 by means of a first sound-generating system 40 such that the ink drops are deflected in a new deflection direction 100*a*. The interval segments of the ink jet 9 that are not required for the print format travel into a collection opening 19 of a collection tube 18 arranged immediately downstream of the sound-generating system 40 and are transported back to the ink cycle via return lines 4*b*. The ink drops 11 separated from the ink jet 9 are then acted upon by one of the two subsequent sound-generating systems 41, 43 by means of acoustic pulses such that individual ink drops 13 can be deflected in a new direction 101, 102, 103. It can be useful for the focal points 41*c*, 43*c* of each of the sound-generating systems 41, 43 to coincide so that mirror-image deflection directions are possible for the propagation direction 100*a* and the drops to be deflected always move through a focal point 41*c* or 43*c*.

Figure 6:
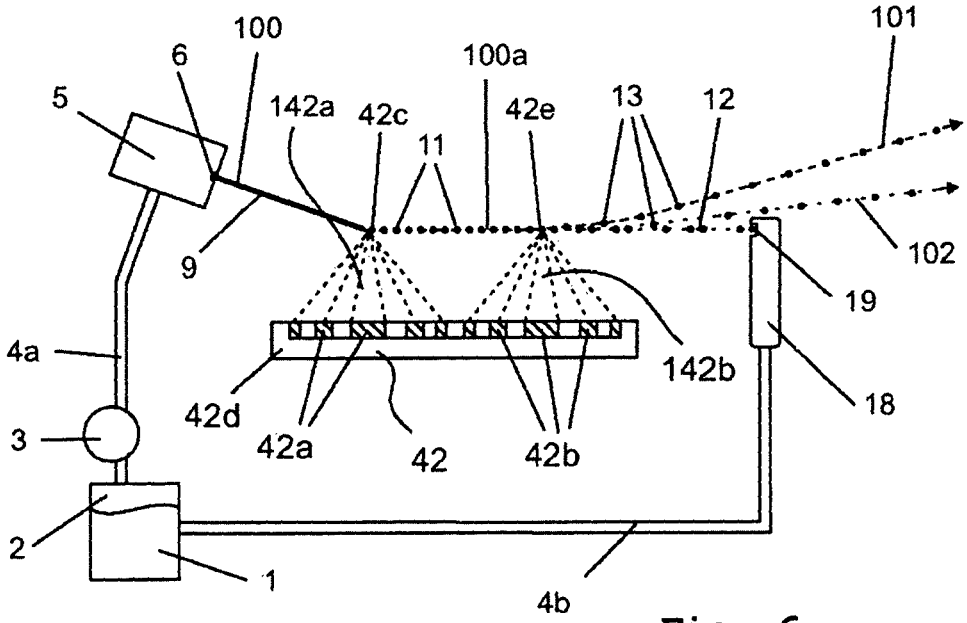
FIG. 6 shows a fifth inventive embodiment having a Fourier-transformed sound-generating system with two focal points that are independent of each other.

FIG. 6 shows a fifth inventive embodiment for producing ink drops and deflecting them, in which embodiment the sound-generating system 42 is embodied such that it can be operated as a Fourier transform system for at least two point acoustic events. For instance, a number of sound-generating segments 42*a* can be actuated in a first region via a higher-level controller (not shown) such that the sound waves 142*a* they have transmitted are bundled in a first focal point 42*c*. Thus, using appropriate actuation of the sound-generating segment 42*a* it is possible to completely break down into uniform and individual ink drops 11 the continuous and cohesive ink jet 9 that passes through the focal point 42*c* and to deflect the ink drops 11 produced in this manner out of the original propagation direction 100 of the ink jet 9 in a new propagation direction 100*a*.

A second group of sound-generating segments 42*b* can be actuated in a downstream region for instance via a higher-level controller (not shown) such that individual ink drops can be deflected in different directions 101, 102. For this, the propagation direction 100*a* of the ink drops runs through the focal point 42*e* of the second segment arrangement 42*b*. Ink drops that are not to be used for printing are not deflected and are returned to the ink cycle in the usual manner.

When using "Fourier-transform" sound-generating systems it is advantageous that by overlaying the sound waves emitted by all of the participating sound-generating segments the position and the shape of the Fourier-transformed acoustic event in the focal point can be varied in that for instance for each segment its frequency spectrum, temporal acoustic course, amplitudes, and phase angle is adjusted. This makes it possible, at least in certain limits, to influence the shape of the focal point and its position with respect to the ink jet 9 and where necessary to account for a certain spacing in order to optimize the addition of the acoustic energy to the ink jet.

With regard to all of the embodiments it should be stated that the technical features cited in connection with one embodiment can be used not only in that specific embodiment, but rather can also be used in each of the other embodiments. All of the disclosed technical features in this description are essential and can be combined with one another as desired or used alone.

The invention claimed is:

1. A method for producing and deflecting ink drops in a continuous ink-jet printer, the method comprising the steps of:

projecting a continuous cohesive ink jet from a nozzle of a pressure chamber in a longitudinal propagation direction;

directing at least one acoustic pulse at the longitudinally traveling cohesive ink jet such that the pulse strikes the cohesive ink jet transversely to the longitudinal propagation direction and thereby separates one segment of the continuous ink jet upon which the acoustic pulse acts from the cohesive ink jet and deflects the separated segment from the longitudinal propagation direction such that the separated segment forms an ink drop during its further travel due to cohesion forces.

2. The method in accordance with claim 1 wherein for producing the at least one acoustic pulse at least one sound generator is used that can be actuated in a pulsed manner and that is provided outside the pressure chamber and that is arranged along the propagation direction of the continuous and cohesive ink jet, at least one acoustic pulse being produced with at least one sound generator and being aimed at a right angle to the continuous ink jet.

3. The method in accordance with claim 1 wherein ink drops are selectively separated from the continuous and cohesive ink jet using acoustic pulses that act on the ink jet transverse to the propagation direction of the ink jet.

4. Method in accordance with claim 1 wherein the cohesive ink jet is acted upon with successive acoustic pulses transverse to the propagation direction of the ink jet such that ink jet segments are formed that are deflected and not deflected from the original propagation direction, non-deflected segments striking a collection device arranged in the original propagation direction and being returned to the ink cycle.

5. The method in accordance with claim 1 wherein the cohesive ink jet is acted upon with successive acoustic pulses transverse to the propagation direction of the ink jet such that only ink jet segments deflected from the original propagation direction occur that form ink drops.

6. The method in accordance with claim 1 wherein the separated segments form ink drops having largely the same size.

7. The method in accordance with claim 1 wherein the separated segments form ink drops having different sizes.

8. The method in accordance with claim 1 wherein ink drops separated from the ink jet can be deflected in selective different directions using at least one acoustic pulse acting on the ink jet transverse to the propagation direction of the ink jet.

9. The method in accordance with claim 1 wherein the at least one acoustic pulse is focused on the cohesive ink jet.

10. The method in accordance with claim 9 wherein the at least one acoustic pulse is focused by a focusing device on a segment of the cohesive ink jet.

11. The method in accordance with claim 1 wherein the at least one acoustic pulse is generated by at least one electrodynamic, electrostatic, magneto-dynamic, magneto-static, or piezo-electric converter.

12. The method in accordance with claim 1 wherein the acoustic pulse is generated by means of a sound generator whose shape or whose sound-generating elements correspond to the Fourier transform of a largely point acoustic pulse at a spacing to the ink jet so that actuating the sound generator results in an acoustic pulse that is focused on the ink jet without additional focusing elements.

13. The method in accordance with claim 1 wherein a focus of the acoustic pulse during its duration coincides with the movement of the ink jet.

14. The method in accordance with claim 1 wherein after a segment is deflected from the cohesive ink jet, at least one additional acoustic pulse acts on the ink drop formed from the segment in order to variably deflect the drop.

15. The method in accordance with claim 1 wherein the strength with which a segment or drop is deflected is a function of or is controlled by the energy or pulse or focusing of an acoustic pulse.

16. The method in accordance with claim 1 wherein sound generators are arranged on two sides of a separated and deflected ink drop jet or the original cohesive ink jet in order to selectively deflect the ink drops on two different sides of the previous propagation direction.

17. A device for producing and deflecting ink drops from a cohesive ink jet, the device comprising:

a pressure chamber having a nozzle for producing a continuously exiting cohesive ink jet moving in a longitudinal propagation direction;

at least one sound generator outside the pressure chamber and directed transversely to the direction at the ink jet for projecting at least one acoustic pulse at the cohesive ink jet and thereby separating ink drops from the cohesive ink jet and deflecting the separated drops from travel in the longitudinal direction.

18. The device in accordance with claim 17 wherein ink drops can be selectively separated from the continuous and cohesive ink jet.

19. The device in accordance with claim 17 wherein ink drops separated from the ink jet can be deflected in selective different directions using the sound generator or at least one sound generator that is downstream in the propagation direction.

20. The device in accordance with claim 17 wherein the non-separated regions of the ink jet travel into a collection device and are returned to the ink cycle.

21. The device in accordance with claim 17 wherein one sound generator is embodied as an electrodynamic or electrostatic or magneto-dynamic or magneto-static or piezo-electric converter.

22. The device in accordance with claim 17 wherein it has a focusing device for focusing the at least one acoustic pulse on a segment of the cohesive ink jet or a produced drop.

23. The device in accordance with claim 17 wherein the sound generator has a shape or arrangement of sound-generating elements that corresponds to the Fourier transform of a largely point acoustic pulse at a spacing to the ink jet so that by actuating the sound generator it is possible to generate an acoustic pulse that is focused on the ink jet without additional focusing elements.

* * * * *